US005744422A

United States Patent [19]

Evans et al.

[11] Patent Number: 5,744,422

[45] Date of Patent: Apr. 28, 1998

[54] ASSEMBLAGE FOR THERMAL DYE TRANSFER

[75] Inventors: Steven Evans, Rochester; Helmut Weber, Webster; Kristine B. Lawrence; Robert A. Guistina, both of Rochester, all of N.Y.

[73] Assignee: Eastman Kodak Company, Rochester, N.Y.

[21] Appl. No.: 878,704

[22] Filed: Jun. 19, 1997

[51] Int. Cl.[6] ..... B41M 5/035; B41M 5/38

[52] U.S. Cl. ..... 503/227; 428/195; 428/331; 428/913; 428/914

[58] Field of Search ..... 8/471; 428/195, 428/331, 341, 500, 913, 914

[56] References Cited

U.S. PATENT DOCUMENTS 5,523,274 6/1996 Shuttleworth et al. ..... 503/227

FOREIGN PATENT DOCUMENTS

05/238174 9/1993 Japan .

*Primary Examiner*—Bruce H. Hess
*Attorney, Agent, or Firm*—Harold E. Cole

[57] ABSTRACT

A thermal dye transfer assemblage comprising:

(I) a dye-donor element comprising a support having thereon sequentially repeating dye layer patches of a dye dispersed in a polymeric binder, at least one of the dye patches containing a pendant basic-substituted dye having the formula:

$$A\text{-}(L\text{-}B)_m$$

wherein:

A represents a thermally transferable dye residue,

L represents a divalent linking group,

B represents a basic substituent, and m represents an integer of from 1 to 3; and (II) a dye-receiving element comprising a support having thereon a polymeric dye image-receiving layer, the dye-receiving element being in a superposed relationship with the dye-donor element so that the dye layer is in contact with the polymeric dye image-receiving layer, the polymeric dye image-receiving layer containing a hydrated transition metal or metalloid salt of a strong acid.

10 Claims, No Drawings

ASSEMBLAGE FOR THERMAL DYE TRANSFER

CROSS REFERENCE TO RELATED APPLICATIONS

Reference is made to commonly-assigned U.S. patent application Ser. No. 08/878,924, filed concurrently herewith, entitled "Assemblage for Thermal Dye Transfer" by Bowman et al; Ser. No. 08/878,717, filed concurrently herewith, entitled "Thermal Dye Transfer Assemblage With Low Tg Polymeric Receiver Mixture" by Harrison et al; Ser. No. 08/878,951, filed concurrently herewith, entitled "Thermal Dye Transfer Assemblage With Low Tg Polymeric Receiver Mixture" by Kung et al; Ser. No. 08/879,061, filed concurrently herewith, entitled "Assemblage for Thermal Dye Transfer" by Guistina et al; Ser. No. 08/878,565, filed concurrently herewith, entitled "Thermal Dye Transfer Assemblage With Low Tg Polymeric Receiver Mixture" by Lawrence et al; and Ser. No. 08/878,564, filed concurrently herewith, entitled "Thermal Dye Transfer Assemblage" by Evans et al; the teachings of which are incorporated herein by reference.

FIELD OF THE INVENTION

This invention relates to a thermal dye transfer assemblage wherein the receiver element contains an acidic metal salt and the dye-donor element contains a pendant basic-substituted dye.

BACKGROUND OF THE INVENTION

In recent years, thermal transfer systems have been developed to obtain prints from pictures which have been generated electronically from a color video camera. According to one way of obtaining such prints, an electronic picture is first subjected to color separation by color filters. The respective color-separated images are then converted into electrical signals. These signals are then operated on to produce cyan, magenta and yellow electrical signals. These signals are then transmitted to a thermal printer. To obtain the print, a cyan, magenta or yellow dye-donor element is placed face-to-face with a dye-receiving element. The two are then inserted between a thermal printing head and a platen roller. A line-type thermal printing head is used to apply heat from the back of the dye-donor sheet. The thermal printing head has many heating elements and is heated up sequentially in response to one of the cyan, magenta or yellow signals, and the process is then repeated for the other two colors. A color hard copy is thus obtained which corresponds to the original picture viewed on a screen. Further details of this process and an apparatus for carrying it out are contained in U.S. Pat. No. 4,621,271, the disclosure of which is hereby incorporated by reference.

Dyes for thermal dye transfer imaging should have bright hue, good solubility in coating solvents, good transfer efficiency and good light stability. A dye receiver polymer should have good affinity for the dye and provide a stable (to heat and light) environment for the dye after transfer. In particular, the transferred dye image should be resistant to image degradation by contact with other surfaces, chemicals, fingerprints, etc. Such image degradation is often the result of continued migration of the transferred dyes after the printing step.

Commonly-used dyes are nonionic in character because of the easy thermal transfer achievable with this type of compound. The dye-receiver layer usually comprises an organic polymer with polar groups to accept the dyes transferred to it. A disadvantage of such a system is that, since the dyes are designed to be mobile within the receiver polymer matrix, the prints generated can suffer from dye migration over time.

A number of attempts have been made to overcome the dye migration problem which usually involves creating some kind of bond between the transferred dye and the polymer of the dye image-receiving layer. One such approach involves the transfer of a cationic dye to an anionic dye-receiving layer, thereby forming an electrostatic bond between the two. However, this technique involves the transfer of a cationic species which, in general, is less efficient than the transfer of a nonionic species.

DESCRIPTION OF RELATED ART

JP 05/238174 describes the thermal transfer of pendant basic-substituted dyes to a receiver element containing organic acidic materials. The common basic substituents disclosed are amines and the preferred acidic materials are relatively weak acids such as carboxylic acids or phenols. However, these receiver elements do not totally inhibit subsequent migration of the basic dyes to other surfaces.

U.S. Pat. No. 5,523,274 relates to a thermal dye transfer system wherein the receiver element contains a polymer substituted with strongly acidic groups such as sulfonic acids. However, there is a problem when trying to use such a strongly acidic receiving element with other types of basic dyes such as typical pendant basic-substituted azo dyes. These dyes are found to undergo varying amounts of protonation at the azo group in addition to the desired protonation on the pendant basic group in such strongly acidic environments. This "overprotonation" causes variable and undesirable color shifts.

It is an object of this invention to provide a thermal dye transfer assemblage employing an acidic dye-receiver which does not induce undesirable color shifts of a pendant basic-substituted dye transferred to it due to overprotonation. It is another object of this invention to provide a thermal dye transfer assemblage employing an acidic dye-receiver which upon transfer of the dye to it would reduce the tendency to retransfer to unwanted surfaces.

SUMMARY OF THE INVENTION

These and other objects are achieved in accordance with this invention which relates to a thermal dye transfer assemblage comprising:

(I) a dye-donor element comprising a support having thereon sequentially repeating dye layer patches of a dye dispersed in a polymeric binder, at least one of the dye patches containing a pendant basic-substituted dye having the formula:

$$A\text{-}(L\text{-}B)_m$$

wherein:

A represents a thermally transferable dye residue, e.g., any of the dye classes described in the art for use in thermal transfer imaging such as azo, methine, merocyanine, indoaniline, anthraquinone, etc.;

L represents a divalent linking group, such as an arylene or hetarylene group having from about 5 to about 30 atoms, or an alkylene group having from about 1 to about 30 carbon atoms, wherein the alkylene, arylene and hetarylene groups may be further substituted with groups such as alkyl, aryl, hetaryl, vinyl, halogen, hydroxy, alkoxy, cyano, alkoxycarbonyl, etc.; the alkylene group may also be interrupted by other divalent groups such as arylene, hetarylene, vinylene, —CO—, —O—, —S—, —NR—, —SO—, —$SO_2$—, —NRCO—, —$NRSO_2$—, —NRCOO—, —COO—, —OCO—, —NRCONR—, $NRSO_2NR$—, etc., where R represents H, alkyl or aryl;

B represents a basic substituent such as a primary, secondary or tertiary aliphatic or aromatic amine or a basic nitrogen-containing heterocycle; and m represents an integer of from 1 to 3; and (II) a dye-receiving element comprising a support having thereon a polymeric dye image-receiving layer, the dye-receiving element being in a superposed relationship with the dye-donor element so that the dye layer is in contact with the polymeric dye image-receiving layer, the polymeric dye image-receiving layer containing a hydrated transition metal or metalloid salt of a strong acid.

DESCRIPTION OF THE PREFERRED EMBODIMENTS

In the above formula, L can represent —$C_2H_4$—, m—$C_6H_4$—, —$C_2H_4OC_2H_4$—, —p—$C_6H_4C_2H_4$—, —$C_3H_6$—, —$C_2H_4CH$=$CHCH_2$—, $CH_2C(CH_3)_2C_2H_4$—,

—$COCH_2$—, —$NHCOCH_2$—,

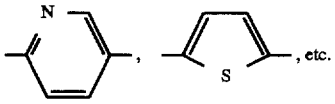

In the above formula, B can represent —$NH_2$, —$N(CH_3)_2$, —$N(C_2H_5)_2$, 2-pyridyl, 1-imidazolyl, morpholino, —$NHC_6H_5$, etc.

The dye described above may be employed in any amount effective for the intended purpose. In general, good results have been obtained when the dye is present in an amount of from about 0.05 to about 1.0 g/$m^2$, preferably from about 0.1 to about 0.5 g/$m^2$. Dye mixtures may also be used.

It has been found that the receiver element which contains a hydrated transition metal or metalloid salt of a strong acid is surprisingly effective at inhibiting the subsequent migration of thermally transferred basic dyes. In addition, such receiver elements do not induce undesirable color shifts of the pendant basic-substituted dyes due to overprotonation.

Dyes having the formula A-(L-B)$_m$ when B represents a primary or secondary amine are described in U.S. Pat. No. 5,510,314, the disclosure of which is hereby incorporated by reference. Other dyes included within the scope of the above formula are disclosed in JP 5/238174, the disclosure of which is hereby incorporated by reference.

Examples of dyes having the formula A-(L-B)$_m$ include the following (Dyes 1–3 are pendant basic magenta dyes and are similar to dyes 38 and 40 described in JP 05/238174):

Dye 1

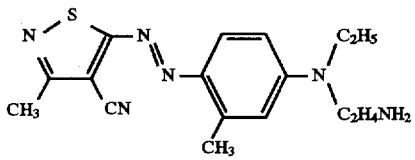

-continued

Dye 2

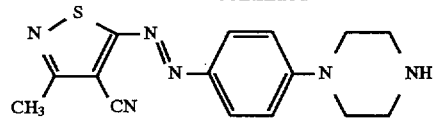

Dye 3

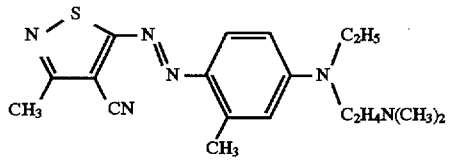

The hydrated transition metal or metalloid salt of a strong acid useful in the invention include various hydrated forms of the following transition metal or metalloid salts: aluminum sulfate, aluminum nitrate, aluminum chloride, potassium aluminum sulfate (alum), zinc sulfate, zinc nitrate, zinc chloride, nickel sulfate, nickel nitrate, nickel chloride, ferric sulfate, ferric chloride, ferric nitrate, cupric sulfate, cupric chloride, cupric nitrate, antimony (III) chloride, cobalt (II) chloride, ferrous sulfate, stannic chloride, aluminum trichloroacetate, zinc bromide, aluminum tosylate, zirconium (IV) chloride, etc. In a preferred embodiment of the invention, the metalloid salt is $Al_2(SO_4)_3.18H_2O$, $AlK(SO_4)_2.12H_2O$, $NiSO_4.6H_2O$, $ZnSO_4.7H_2O$, $CuSO_4.5H_2O$, $Fe_2(SO_4)_3.4H_2O$, $Al(NO_3)_3.9H_2O$, $Ni(NO_3)_2.6H_2O$, $Zn(NO_3)_2.6H_2O$, $Fe(NO_3)_3.9H_2O$ or $AlCl_3.6H_2O$. Mixtures of the above salts and complexes thereof may also be used.

Any amount of hydrated transition metal or metalloid salt of a strong acid can be used in the receiver as long as it is sufficient to fully protonate the dyes transferred to the receiver. In general, good results have been obtained when the hydrated transition metal or metalloid salt of a strong acid is employed at a concentration of from about 0.05 to about 1.5 g/$m^2$, preferably from about 0.1 to about 0.8 g/$m^2$.

Any type of polymer may be employed in the receiver, e.g., condensation polymers such as polyesters, polyurethanes, polycarbonates, etc.; addition polymers such as polystyrenes, vinyl polymers, etc.; block copolymers containing large segments of more than one type of polymer covalently linked together. In a preferred embodiment of the invention, the dye image-receiving layer comprises an acrylic polymer, a styrene polymer, a polyester, a polyamide, a polyurethane, a polyolefin or a phenolic resin.

The polymer in the dye image-receiving layer may be present in any amount which is effective for its intended purpose. In general, good results have been obtained at a concentration of from about 0.5 to about 10 g/$m^2$. The polymers may be coated from organic solvents or water, if desired.

The support for the dye-receiving element employed in the invention may be transparent or reflective, and may comprise a polymeric, synthetic or cellulosic paper support, or laminates thereof. Examples of transparent supports include films of poly(ether sulfone)s, poly(ethylene naphthalate), polyimides, cellulose esters such as cellulose acetate, poly(vinyl alcohol-co-acetal)s, and poly(ethylene terephthalate). The support may be employed at any desired thickness, usually from about 10 μm to 1000 μm. Additional polymeric layers may be present between the support and the dye image-receiving layer. For example, there may be employed a polyolefin such as polyethylene or polypropylene. White pigments such as titanium dioxide, zinc oxide, etc., may be added to the polymeric layer to provide reflectivity. In addition, a subbing layer may be used over this polymeric layer in order to improve adhesion to the dye image-receiving layer. Such subbing layers are disclosed in U.S. Pat. Nos. 4,748,150, 4,965,238, 4,965,239, and 4,965, 241, the disclosures of which are incorporated by reference. The receiver element may also include a backing layer such as those disclosed in U.S. Pat. Nos. 5,011,814 and 5,096,875, the disclosures of which are incorporated by reference. In a preferred embodiment of the invention, the support comprises a microvoided thermoplastic core layer coated with thermoplastic surface layers as described in U.S. Pat. No. 5,244,861, the disclosure of which is hereby incorporated by reference.

Resistance to sticking during thermal printing may be enhanced by the addition of release agents to the dye-receiving layer or to an overcoat layer, such as silicone-based compounds, as is conventional in the art.

Any material can be used as the support for the dye-donor element employed in the invention, provided it is dimensionally stable and can withstand the heat of the thermal printing heads. Such materials include polyesters such as poly(ethylene terephthalate); polyamides; polycarbonates; glassine paper; condenser paper; cellulose esters such as cellulose acetate; fluorine polymers such as poly(vinylidene fluoride) or poly(tetrafluoroethylene-co-hexafluoropropylene); polyethers such as polyoxymethylene; polyacetals; polyolefins such as polystyrene, polyethylene, polypropylene or methylpentene polymers; and polyimides such as polyimide amides and polyetherimides. The support generally has a thickness of from about 2 to about 30 μm.

Dye-donor elements used in the invention conventionally comprise a support having thereon a dye layer containing the dyes as described above dispersed in a polymeric binder such as a cellulose derivative, e.g., cellulose acetate hydrogen phthalate, cellulose acetate, cellulose acetate propionate, cellulose acetate butyrate, cellulose triacetate, or any of the materials described in U.S. Pat. No. 4,700,207; or a poly (vinyl acetal) such as poly(vinyl alcohol-co-butyral). The binder may be used at a coverage of from about 0.1 to about 5 $g/m^2$.

As noted above, dye-donor elements are used to form a dye transfer image. Such a process comprises imagewise-heating a dye-donor element and transferring a dye image to a dye-receiving element as described above to form the dye transfer image.

In a preferred embodiment of the invention, a dye-donor element is employed which comprises a poly(ethylene terephthalate) support coated with sequential repeating areas of at least one of the dyes, as described above, capable of generating a cyan, magenta or yellow dye image and the dye transfer steps are sequentially performed for each color to obtain a three-color dye transfer image. Of course, when the process is only performed for a single color, then a monochrome dye transfer image is obtained.

Thermal print heads which can be used to transfer dye from dye-donor elements to the receiving elements of the invention are available commercially. There can be employed, for example, a Fujitsu Thermal Head (FTP-040 MCS001), a TDK Thermal Head F415 HH7-1089 or a Rohm Thermal Head KE 2008-F3. Alternatively, other known sources of energy for thermal dye transfer may be used, such as lasers as described in, for example, GB 2,083,726A.

When a three-color image is to be obtained, the assemblage described above is formed on three occasions during the time when heat is applied by the thermal printing head. After the first dye is transferred, the elements are peeled apart. A second dye-donor element (or another area of the donor element with a different dye area) is then brought in register with the dye-receiving element and the process repeated. The third color is obtained in the same manner. After thermal dye transfer, the dye image-receiving layer contains a thermally-transferred dye image.

The following example is provided to further illustrate the invention.

EXAMPLE

The following polymers were used to prepare dye-receiving elements:

Polymer 1: Vylon® 200 ( Toyobo Co., Ltd.), similar to Vylon® 280, described in JP 05/238174, Example 1.

Polymer 2: Poly(butyl acrylate-co-2-acrylamido-2-methylpropanesulfonic acid) (70/30 wt. ratio), similar to Receiver 1 of U.S. Pat. No. 5,534,479.

Polymer 3: Poly(methyl methacrylate-co-butyl acrylate-co-2-hydroxyethyl methacrylate-co-2-sulfoethyl methacrylate sodium salt) (30/50/10/10 wt ratio, Tg=−3° C.)

Preparation of Dye-Donor Elements

Individual dye-donor elements were prepared by coating the following compositions in the order listed on a 6 μm poly(ethylene terephthalate) support:

1) a subbing layer of Tyzor TBT®, a titanium tetrabutoxide, (DuPont Company) (0.16 $g/m^2$) coated from 1-butanol; and 2) a dye layer containing one of the dyes described above, and FC-431® fluorocarbon surfactant (3M Company) (0.01 $g/m^2$) in a poly(vinyl butyral) binder, (Butvar® B-76, Monsanto Company) coated from a toluene/n-propanol/cyclohexanone(65/30/5) solvent mixture.

Details of dye and binder laydowns are given in Table 1.

On the back side of the dye-donor element were coated the following compositions in the order listed:

1) a subbing layer of Tyzor TBT®, a titanium tetrabutoxide, (DuPont Company) (0.16 $g/m^2$) coated from 1-butanol; and 2) a slipping layer of Emralon 329® (Acheson Colloids Co.), a dry film lubricant of poly(tetrafluoroethylene) particles in a cellulose nitrate resin binder (0.54 $g/m^2$) and S-nauba micronized carnauba wax (0.016 $g/m^2$) coated from a n-propyl acetate, toluene, isopropyl alcohol and n-butyl alcohol solvent mixture.

TABLE 1

| Dye-Donor Element | Dye | Dye Laydown ($g/m^2$) | Butvar ® 76 Binder Laydown ($g/m^2$) |
|---|---|---|---|
| 1 | 1 | 0.203 | 0.408 |
| 2 | 2 | 0.231 | 0.462 |
| 3 | 3 | 0.213 | 0.426 |

Preparation of Dye-Receiver Elements

Dye-receiver elements described below were prepared by first extrusion laminating a paper core with a 38 μm thick microvoided composite film (OPPalyte® 350TW, Mobil Chemical Co.) as disclosed in U.S. Pat. No. 5,244,861.

Control Receiver Element 1:

This receiver element was essentially as described in Example 1 of JP 05/238174.

The composite film side of the above laminate was coated with the following layers in the order recited:

1) a subbing layer of 0.02 $gm^2$ Polymin P® polyethyleneimine (BASF Corp.) coated from water; and 2) a dye-receiving layer composed of 7.23 $g/m^2$ of Polymer 1, 0.72 $g/m^2$ of trichlorophenol (acidic substance I-12 of JP 05/238174) and 0.66 $g/m^2$ polyisocyanate (Desmodour N3300®, Mobay Corp.) coated from toluene, MEK and cyclohexanone (46/46/8).

Control Receiver Element 2:

This receiver element was essentially that described as Receiver 1 in U.S. Pat. No. 5,534,479 and was prepared as described above for Control Receiver Element 1, except the dye-receiving layer contained 6.73 $g/m^2$ of Polymer 2 coated from methanol.

Control Receiver Element 3:

This receiver element was prepared exactly as described above for Control Receiver Element 1, except the dye-receiving layer contained 6.73 g/m$^2$ of Polymer 3 coated from water.

Invention Receiver Element I-1:

The dye receiver element of the invention was prepared as described above for Control Receiver Element 1, except the dye-receiving layer was composed of 6.13 g/m$^2$ of Polymer 4 and 0.59 g/m$^2$ of $Al_2(SO_4)_3.18H_2O$ coated from water.

Invention Receiver Elements I-2 through 8:

Invention Receiver Elements I-2 through 8 were prepared exactly as described for Invention Receiver Element 1, except the $Al_2(SO_4)_3.18H_2O$ was replaced with other metal or metalloid salts of strong acids in equimolar amounts as listed below in Table 2. The dry laydowns in g/m$^2$ and the coating solvents used are also summarized in Table 2.

TABLE 2

Receiver Element Compositions

| Receiver Element | Polymer | Polymer Laydown (g/m$^2$) | Metal Salt (g/m$^2$) | Solvent |
|---|---|---|---|---|
| C-1 | 1 | 7.23 | none | Toluene/MEK/ Cyclohexanone |
| C-2 | 2 | 6.72 | none | Methanol |
| C-3 | 3 | 6.72 | none | Methanol |
| C-4 | 4 | 6.72 | none | Water |
| I-1 | 4 | 6.13 | $Al_2(SO_4)_3.18\ H_2O$ (0.59) | Water |
| I-2 | 4 | 6.39 | $Al(NO_3)_3.9\ H_2O$ (0.34) | Water |
| I-3 | 4 | 6.51 | $AlCl_3.6\ H_2O$ (0.22) | Water |
| I-4 | 4 | 6.46 | $Zn(NO_3)_2.6\ H_2O$ (0.27) | Water |
| I-5 | 4 | 6.47 | $ZnSO_4.7\ H_2O$ (0.26) | Water |
| I-6 | 4 | 6.49 | $NiSO_4.6\ H_2O$ (0.24) | Water |
| I-7 | 4 | 6.59 | $CuSO_4.5\ H_2O$ (0.14) | Water |
| I-8 | 4 | 6.31 | $Fe_2(SO_4)_3.4\ H_2O$ (0.42) | Water |

Preparation and Evaluation of Thermal Dye Transfer Images

Eleven-step sensitometric thermal dye transfer images were prepared from the above dye-donor and dye-receiver elements. The dye side of the dye-donor element approximately 10 cm×15 cm in area was placed in contact with the receiving-layer side of a dye-receiving element of the same area. This assemblage was clamped to a stepper motor-driven, 60 mm diameter rubber roller. A thermal head (TDK No. 810625, thermostatted at 25° C.) was pressed with a force of 24.4 Newton (2.5 kg) against the dye-donor element side of the assemblage, pushing it against the rubber roller.

The imaging electronics were activated causing the donor-receiver assemblage to be drawn through the printing head/roller nip at 40.3 mm/sec. Coincidentally, the resistive elements in the thermal print head were pulsed for 127.75 μs/pulse at 130.75 μs intervals during a 4.575 ms/dot printing cycle (including a 0.391 ms/dot cool down interval). A stepped image density was generated by incrementally increasing the number of pulses/dot from a minimum of 0 to a maximum of 32 pulses/dot. The voltage supplied to the thermal head was approximately 14.0 v resulting in an instantaneous peak power of 0.369 watts/dot and a maximum total energy of 1.51 mJ/dot. Print room humidity: 40%–45% RH.

After printing, the dye-donor element was separated from the imaged receiving element, and the latter was placed into an oven at 50° C./50% RH for 3 hours to ensure that the dye was evenly distributed throughout the receiving layer. After incubation, the appropriate (red, green or blue) Status A, reflection density of each of the eleven steps in the stepped-image was measured with an X-Rite® 820 Reflection Densitometer (X-Rite Corp.).

The degree of undesirable hue shifts due to either insufficient or excess acidity in the receiver element could be estimated by comparing ratios of the various Status A reflection densities measured above. For magenta dyes the Green/Blue and Green/Red Ratios should be high while for cyan dyes the Red/Green Ratio should be high. The Status A reflection densities and the appropriate ratios are listed in Tables 3–5.

The imaged side of the stepped image was then placed in intimate contact with a similarly sized piece of a plasticized poly(vinyl chloride) (PVC) report cover, a 1 kg weight was placed on top and the whole assemblage was incubated in an oven held at 50° C. for 1 week. The PVC sheet was separated from the stepped image and the appropriate Status A transmission density in the PVC (a measure of the amount of unwanted dye migration into the PVC) of the step, corresponding to an initial Status A reflection density reading of approximately 1.0, was measured with an X-Rite 820 Reflection Densitometer. The results of these measurements are also given in Tables 3–5.

TABLE 3

Results for Basic Pendant Dye 1

| Dye-Donor Element | Dye-Receiver Element | Initial Reflection Density[1] | Retransfer Density[2] | Status A Green/Red Ratio |
|---|---|---|---|---|
| 1 | C-1 | 1.21 | 0.22 | 5.5 |
| 1 | C-2 | 1.23 | 0.02 | 2.3* |
| 1 | C-3 | 1.36 | 0.22 | 10.5 |
| 1 | I-1 | 1.06 | 0.02 | 7.6 |
| 1 | I-2 | 1.11 | 0.03 | 9.3 |
| 1 | I-3 | 1.02 | 0.02 | 8.5 |
| 1 | I-4 | 1.14 | 0.03 | 7.6 |
| 1 | I-5 | 1.04 | 0.03 | 6.9 |
| 1 | I-6 | 1.38 | 0.03 | 8.6 |
| 1 | I-7 | 1.34 | 0.03 | 4.5 |
| 1 | I-8 | 1.01 | 0.02 | 7.2 |

[1]Status A Green
[2]Status A Green Transmission Density
*muddy desaturated brown hue

TABLE 4

Results for Basic Pendant Dye 2

| Dye-Donor Element | Dye-Receiver Element | Initial Reflection Density[1] | Retransfer Density[2] | Status A Green/Red Ratio |
|---|---|---|---|---|
| 2 | C-1 | 1.24 | 0.21 | 7.3 |
| 2 | C-2 | 1.03 | 0.03 | 4.0 |
| 2 | C-3 | 1.03 | 0.22 | 12.9 |
| 2 | I-1 | 1.09 | 0.02 | 12.1 |
| 2 | I-2 | 1.04 | 0.02 | 13.0 |
| 2 | I-3 | 1.05 | 0.02 | 13.1 |
| 2 | I-4 | 1.16 | 0.02 | 12.9 |
| 2 | I-5 | 1.14 | 0.02 | 14.3 |
| 2 | I-6 | 1.15 | 0.03 | 14.4 |
| 2 | I-7 | 1.12 | 0.03 | 8.0 |
| 2 | I-8 | 1.07 | 0.02 | 13.4 |

[1]Status A Green
[2]Status A Green Transmission Density

TABLE 5

Results for Basic Pendant Dye 3

| Dye-Donor Element | Dye-Receiver Element | Initial Reflection Density[1] | Retransfer Density[2] | Status A Green/Red Ratio |
|---|---|---|---|---|
| 3 | C-1 | 1.00 | 0.38 | 5.6 |
| 3 | C-2 | 1.04 | 0.03 | 2.4* |
| 3 | C-3 | 1.26 | 0.28 | 11.5 |
| 3 | I-1 | 1.17 | 0.02 | 9.8 |
| 3 | I-2 | 1.24 | 0.04 | 11.3 |
| 3 | I-3 | 1.24 | 0.03 | 11.3 |
| 3 | I-4 | 1.23 | 0.06 | 10.3 |
| 3 | I-5 | 1.21 | 0.06 | 11.0 |
| 3 | I-6 | 1.26 | 0.11 | 11.5 |
| 3 | I-7 | 1.27 | 0.03 | 7.9 |
| 3 | I-8 | 1.25 | 0.02 | 9.6 |

[1]Status A Green
[2]Status A Green Transmission Density
*muddy desaturated brown hue The above data show that the receiving elements of the invention which contain hydrated transition metal and metalloid salts of strong acids are very effective at inhibiting dye migration (low retransfer density numbers) and give images without color degradation. Control Receivers 1 and 3 fail to adequately inhibit dye migration. While Control Receiver 2 does inhibit dye migration, it causes undesirable hue shifts (low green/red ratios).

The invention has been described in detail with particular reference to preferred embodiments thereof, but it will be understood that variations and modifications can be effected within the spirit and scope of the invention.

What is claimed is:

1. A thermal dye transfer assemblage comprising:

(I) a dye-donor element comprising a support having thereon sequentially repeating dye layer patches of a dye dispersed in a polymeric binder, at least one of said dye patches containing a pendant basic-substituted dye having the formula:

$$A\text{-}(L\text{-}B)_m$$

wherein:

A represents a thermally transferable dye residue,

L represents a divalent linking group,

B represents a basic substituent, and m represents an integer of from 1 to 3; and (II) a dye-receiving element comprising a support having thereon a polymeric dye image-receiving layer, said dye-receiving element being in a superposed relationship with said dye-donor element so that said dye layer is in contact with said polymeric dye image-receiving layer, said polymeric dye image-receiving layer containing a hydrated transition metal or metalloid salt of a strong acid.

2. The assemblage of claim 1 wherein said polymeric dye image-receiving layer comprises an acrylic polymer, a styrene polymer, a polyester, a polyamide, a polyurethane, a polyolefin or a phenolic resin.

3. The assemblage of claim 1 wherein said hydrated transition metal or metalloid salt of a strong acid is a hydrated form of: aluminum sulfate, aluminum nitrate, aluminum chloride, potassium aluminum sulfate, zinc sulfate, zinc nitrate, zinc chloride, nickel sulfate, nickel nitrate, nickel chloride, ferric sulfate, ferric chloride, ferric nitrate, cupric sulfate, cupric chloride, cupric nitrate, antimony (III) chloride, cobalt (II) chloride, ferrous sulfate, stannic chloride, aluminum trichloroacetate, zinc bromide, aluminum tosylate, or zirconium (IV) chloride.

4. The assemblage of claim 1 wherein said receiving layer contains $Al_2(SO_4)_3.18H_2O$, $AlK(SO_4)_2.12H_2O$, $NiSO_4.6H_2O$, $ZnSO_4.7H_2O$, $CuSO_4.5H_2O$, $Fe_2(SO_4)_3.4H_2O$, $Al(NO_3)_3.9H_2O$, $Ni(NO_3)_2.6H_2O$, $Zn(NO_3)_2.6H_2O$, $Fe(NO_3)_3.9H_2O$ or $AlCl_3.6H_2O$.

5. The assemblage of claim 1 wherein said hydrated transition metal or metalloid salt of a strong acid is employed at a concentration of from about 0.05 to about 1.5 $g/m^2$.

6. A process of forming a dye transfer image comprising imagewise-heating a dye-donor element comprising a support having thereon a dye layer comprising a dye dispersed in a polymeric binder, and imagewise transferring said dye to a dye-receiving element to form said dye transfer image, wherein said dye-donor element comprises a support having thereon sequentially repeating dye layer patches of a dye dispersed in a polymeric binder, at least one of said dye patches containing a pendant basic-substituted dye having the formula:

$$A\text{-}(L\text{-}B)_m$$

wherein:

A represents a thermally transferable dye residue,

L represents a divalent linking group,

B represents a basic substituent, and m represents an integer of from 1 to 3; and said dye-receiving element comprises a support having thereon a polymeric dye image-receiving layer which contains a hydrated transition metal or metalloid salt of a strong acid.

7. The process of claim 6 wherein said polymeric dye image-receiving layer comprises an acrylic polymer, a styrene polymer, a polyester, a polyamide, a polyurethane, a polyolefin or a phenolic resin.

8. The process of claim 6 wherein said hydrated transition metal or metalloid salt of a strong acid is a hydrated form of: aluminum sulfate, aluminum nitrate, aluminum chloride, potassium aluminum sulfate, zinc sulfate, zinc nitrate, zinc chloride, nickel sulfate, nickel nitrate, nickel chloride, ferric sulfate, ferric chloride, ferric nitrate, cupric sulfate, cupric chloride, cupric nitrate, antimony (III) chloride, cobalt (II) chloride, ferrous sulfate, stannic chloride, aluminum trichloroacetate, zinc bromide, aluminum tosylate, or zirconium (IV) chloride.

9. The process of claim 6 wherein said receiving layer contains $Al_2(SO_4)_3.18H_2O$, $AlK(SO_4)_2.12H_2O$, $NiSO_4.6H_2O$, $ZnSO_4.7H_2O$, $CuSO_4.5H_2O$, $Fe_2(SO_4)_3.4H_2O$, $Al(NO_3)_3.9H_2O$, $Ni(NO_3)_2.6H_2O$, $Zn(NO_3)_2.6H_2O$, $Fe(NO_3)_3.9H_2O$ or $AlCl_3.6H_2O$.

10. The process of claim 6 wherein said hydrated transition metal or metalloid salt of a strong acid is employed at a concentration of from about 0.05 to about 1.5 $g/m^2$.

* * * * *